US010724524B2

(12) United States Patent
Peters et al.

(10) Patent No.: US 10,724,524 B2
(45) Date of Patent: Jul. 28, 2020

(54) COMPRESSOR SYSTEM AND LUBRICANT CONTROL VALVE TO REGULATE TEMPERATURE OF A LUBRICANT

(71) Applicant: Ingersoll-Rand Company, Davidson, NC (US)

(72) Inventors: Michael Peters, Mooresville, NC (US); Kenneth J. Schultz, Onalaska, WI (US); James Christopher Collins, Morresville, NC (US); Nicholas Able, Huntersville, NC (US); Matthew Stinson, Golden Valley, MN (US); Srinivasa Rao Yenneti, Bangalore (IN)

(73) Assignee: Ingersoll-Rand Industrial U.S., Inc, Davidson, NC (US)

( * ) Notice: Subject to any disclaimer, the term of this patent is extended or adjusted under 35 U.S.C. 154(b) by 358 days.

(21) Appl. No.: 15/211,803

(22) Filed: Jul. 15, 2016

(65) Prior Publication Data

US 2018/0017062 A1 Jan. 18, 2018

(51) Int. Cl.
*F04C 29/02* (2006.01)
*F04B 39/06* (2006.01)
(Continued)

(52) U.S. Cl.
CPC ..... *F04C 29/021* (2013.01); *F04B 39/0207* (2013.01); *F04B 39/062* (2013.01);
(Continued)

(58) Field of Classification Search
CPC ..... F04C 29/021; F04C 29/0092; F04C 2270/195; F04C 29/0007; F04C 29/0014;
(Continued)

(56) References Cited

U.S. PATENT DOCUMENTS 3,229,456 A * 1/1966 Gratzmuller ..... F01P 3/2207 123/198 D
3,680,283 A 8/1972 Jones, Jr.
(Continued)

FOREIGN PATENT DOCUMENTS

WO 2005055354 A1 6/2005
WO 2013172789 A1 11/2013
WO 2015114081 A1 6/2015

OTHER PUBLICATIONS

European Patent Office Extended Search Report dated Nov. 29, 2017, cited in co-pending EP Application. 17179277.3 (8 pages).
(Continued)

*Primary Examiner* — Bryan M Lettman
*Assistant Examiner* — Timothy P Solak
(74) *Attorney, Agent, or Firm* — Taft Stettinius & Holllister LLP

(57) ABSTRACT

The present disclosure provides a compressor system operable for compressing a working fluid such as air. A conditioner is positioned upstream of the compressor to reduce the humidity and in some embodiments may control a temperature of the working fluid entering the compressor. A working fluid aftercooler and a lubricant cooler is positioned downstream of the compressor. A first heat exchange system directs water from a source through the conditioner and then to the aftercooler and oil cooler in parallel. A second heat exchange system directs oil from the compressor to the oil cooler and then to a regenerator prior to reentry into the compressor. A control system with one or more control valves is configured to provide oil to the compressor at a target temperature defined to ensure that the temperature of the discharged compressor is above a pressure dew point temperature.

25 Claims, 6 Drawing Sheets

(51) Int. Cl.

| | |
|---|---|
| ***F04B 41/00*** | (2006.01) |
| ***F04B 39/02*** | (2006.01) |
| ***F04B 49/06*** | (2006.01) |
| ***F04B 39/16*** | (2006.01) |
| ***F04C 29/04*** | (2006.01) |
| ***F04B 53/18*** | (2006.01) |
| ***F04C 29/00*** | (2006.01) |

(52) U.S. Cl.
CPC ..... *F04B 39/16* (2013.01); *F04B 41/00* (2013.01); *F04B 49/065* (2013.01); *F04B 53/18* (2013.01); *F04C 29/0007* (2013.01); *F04C 29/0014* (2013.01); *F04C 29/026* (2013.01); *F04C 29/04* (2013.01); *F04C 29/042* (2013.01); *F04B 2201/0402* (2013.01); *F04B 2205/11* (2013.01); *F04C 2270/19* (2013.01); *F04C 2270/195* (2013.01)

(58) Field of Classification Search
CPC .. F04C 29/042; F04C 2270/19; F04B 39/062; F04B 2201/0402; F04B 2205/11; F04B 2207/03
See application file for complete search history.

(56) References Cited

U.S. PATENT DOCUMENTS

| | | | | |
|---|---|---|---|---|
| 4,220,197 | A | 9/1980 | Schaefer | |
| 4,311,439 | A | 1/1982 | Stofen | |
| 4,936,109 | A * | 6/1990 | Longardner | F04D 29/5826 62/238.3 |
| 5,087,178 | A | 2/1992 | Wells | |
| 5,180,003 | A * | 1/1993 | Kouzel | F01P 5/02 123/41.49 |
| 5,318,151 | A | 6/1994 | Hood et al. | |
| 5,489,166 | A | 2/1996 | Schmit | |
| 5,697,763 | A * | 12/1997 | Kitchener | F04C 28/06 417/28 |
| 5,925,169 | A | 7/1999 | Vertriest | |
| 6,494,053 | B1 | 12/2002 | Forkosh et al. | |
| 6,688,857 | B1 | 2/2004 | Choroszylow et al. | |
| 6,807,821 | B2 | 10/2004 | Narney, II | |
| 6,895,774 | B1 | 5/2005 | Ares et al. | |
| 8,347,629 | B2 | 1/2013 | Finkenrath | |
| 8,424,337 | B2 | 4/2013 | Scarcella et al. | |
| 8,955,323 | B2 | 2/2015 | Kamiya | |
| 2003/0121268 | A1 * | 7/2003 | Erickson | F02C 3/305 60/775 |
| 2003/0166466 | A1 * | 9/2003 | Hoke | B01D 53/02 502/439 |
| 2004/0099140 | A1 | 5/2004 | Hesse et al. | |
| 2004/0217180 | A1 * | 11/2004 | Lu | F04C 29/0007 236/44 C |
| 2006/0153699 | A1 * | 7/2006 | Gittoes | F04B 39/14 417/302 |
| 2006/0218938 | A1 * | 10/2006 | Fornof | F04B 39/06 62/3.4 |
| 2008/0279708 | A1 * | 11/2008 | Heimonen | F04C 29/0014 418/84 |
| 2009/0252632 | A1 | 10/2009 | Daniels | |
| 2012/0037352 | A1 * | 2/2012 | Osaka | B60H 1/00021 165/202 |
| 2012/0207621 | A1 | 8/2012 | Halttunen | |
| 2013/0156548 | A1 | 6/2013 | Takano et al. | |
| 2014/0271258 | A1 | 9/2014 | Vezil et al. | |
| 2016/0186757 | A1 | 6/2016 | Collins | |

OTHER PUBLICATIONS

CompAir, Rotary Screw Compressors, Brochure, Re-Order Ref. 91005-096e, 8 pages.

* cited by examiner

COMPRESSOR SYSTEM AND LUBRICANT CONTROL VALVE TO REGULATE TEMPERATURE OF A LUBRICANT

TECHNICAL FIELD

The present application generally relates to industrial air compressor systems and more particularly, but not exclusively, improving compressor system efficiency by controlling a temperature of lubricant injected into the compressor with a control valve.

BACKGROUND

Industrial compressor systems are configured to produce large volumes of pressurized fluid such as air or the like. Efficiency improvements to compressor systems translate into cost savings for the system operator. Some existing systems have various shortcomings relative to certain applications. Accordingly, there remains a need for further contributions in this area of technology.

SUMMARY

One embodiment of the present disclosure is a unique compressor system with a control system operable to control oil inlet temperature such that the pressure dew point temperature of the compressed air is minimized to increase efficiency of the system. Other embodiments include apparatuses, systems, devices, hardware, methods, and combinations for compressor systems with a unique method for increasing thermodynamic efficiency of the compressor system are disclosed herein. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
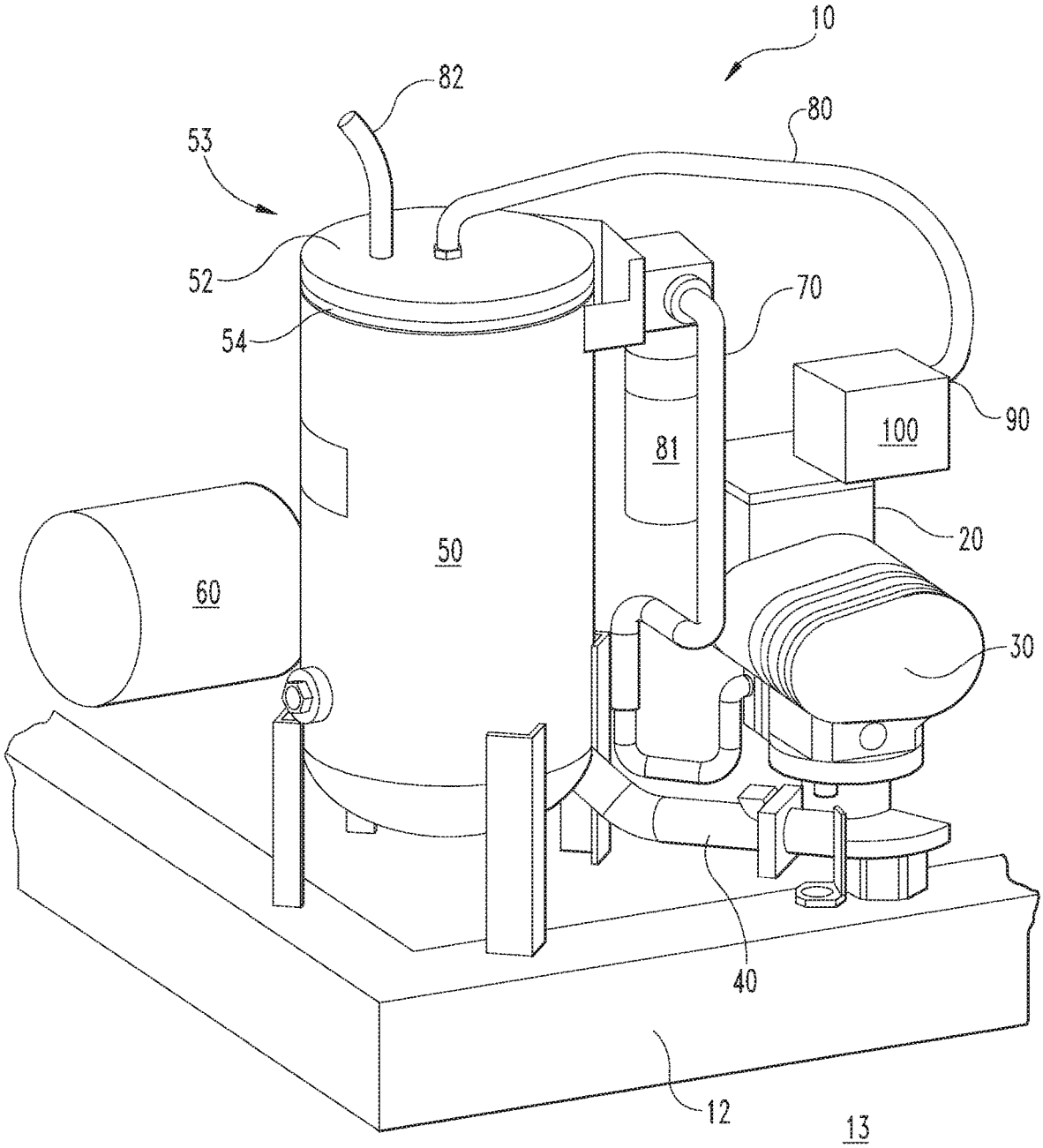
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide compressed fluids at a desired temperature, pressure and mass flow rate. Some compressor systems use fluid to fluid heat exchangers to control the temperature of compressed fluids at various stages within the system. The term "fluid" should be understood to include any gas or liquid medium used in the compressor system as disclosed herein. In some forms the present application can be directed to delivery of pressurized fluid with more than one fluid constituency such as a mixture of air and lubrication fluids including oil or the like. When the terms oil or lubricant are used herein it is intended to refer generally to a class of lubrication fluids that include petroleum based or synthetic formulations and can have a variety of properties and viscosities. When the term air is used it should be understood that other compressible working fluids can be substituted and not depart from the teachings or the present disclosure.

Referring now to FIG. 1, an exemplary compressor system 10 is shown in perspective view. The compressor system 10 includes a primary motive source 20 such as an electric motor, an internal combustion engine or a fluid-driven turbine and the like. The compressor system 10 can include a compressor 30 that may include single or multi-stage compression. The compressor 30 can be defined by oil flooded compressors such as a screw type however other types of oil flooded positive displacement compressors are contemplated herein. The primary motive source 20 is operable for driving the compressor 30 via a drive shaft (not shown) to compress gaseous fluids such as air and oil vapor or the like.

A structural base 12 is configured to support at least portions of the compressor system 10 on a support surface 13 such as a floor or ground. Portions of the compressed working fluid discharged from the compressor 30 can be transported through more one or more conduits 40 to a sump or separator tank 50 for separating fluid constituents such as air and oil or the like. One or more coolers 60 can be operably coupled with the system 10 for cooling working fluids to a desired temperature. The one or more coolers 60 can cool fluids such as compressed air, oil or other fluids to a desired temperature as defined by a control system. The control system can include a controller 100 operable for controlling the primary motive power source 20 and various valving and fluid control mechanisms (not shown) between the compressor 30 and intercoolers 60 such as, for example a blowdown valve 90.

The separator tank 50 can include a lid 52 positioned proximate a top portion 53 thereof. A seal 54 can be positioned between the lid 52 and separator tank 50 so as to provide a fluid tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. In some configurations the blowdown conduit and associated valving may be omitted. An air supply conduit 82 can be operably coupled to the separator tank so as to deliver compressed air to a separate holding tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10.

Figure 2:
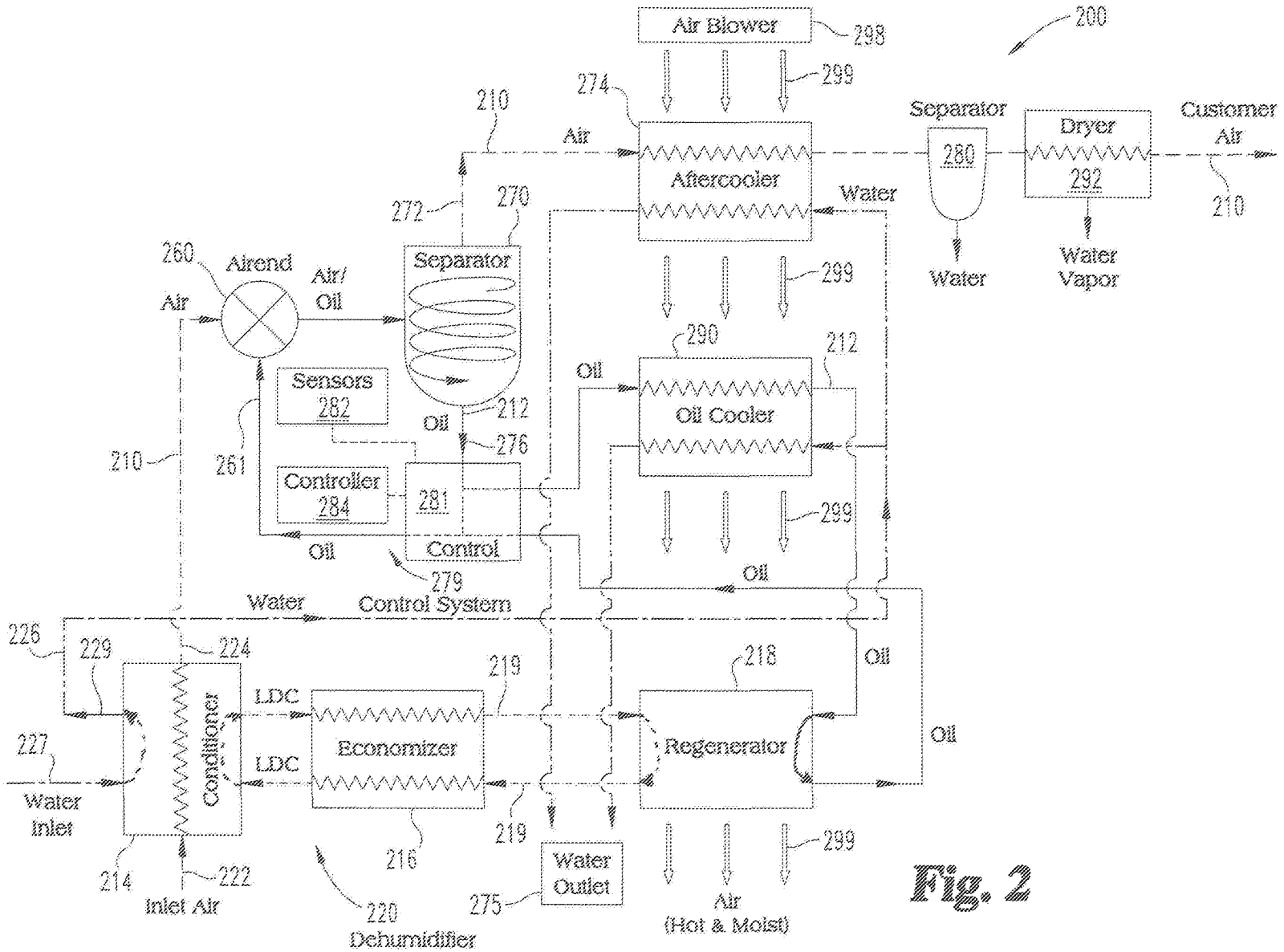
FIG. 2 is a schematic view of a fluid flow diagram according to one embodiment of the present disclosure.

Referring now to FIG. 2, an illustrative embodiment of an exemplary compressor system 200 is depicted therein. The compressor system 200 includes an air circuit 210 delineated by a dashed line and an oil circuit 212 delineated by a solid line to define a flow path for each fluid. The air circuit 210 begins with a source of ambient air that is delivered to a conditioner 214 of a dehumidifier 220 through an air inlet conduit 222. The dehumidifier 220 further includes an economizer 216 and a regenerator 218, each in fluid communication with conditioner 214. A liquid desiccant circuit (LDC) 219 passes in heat and mass transfer relationship with the conditioner 214, the economizer 216 and the regenerator 218. It should be noted that in some embodiments of the present disclosure the dehumidifier 220 will not include an economizer. The air is dried or de-moisturized in the dehumidifier 220 by removing at least a portion of the water vapor entrained therewith. A cooling circuit 226 defines a fluid flow path that traverses through the conditioner 214 and then through an oil cooler 290 and an aftercooler 274 prior to exiting through a water drain 275. In the illustrative embodiment the cooling circuit 226 can include water as a heat transfer medium. Other heat transfer mediums are contemplated such as by way of example and not limitation a glycol solution or a refrigerant. In some forms the cooling circuit 226 may be a closed loop system with a separate heat exchanger (not shown). In other forms the cooling circuit 226 may be an open loop system and include a drain or the like at the outlet 275. The cooling circuit 226 includes an inlet 227 to the conditioner 214 and an outlet 229 in fluid communication with downstream components. The conditioner 214 receives air through the air inlet 222, passes the air flow therethrough and exchanges heat with the cooling circuit 226 to cool and with the liquid desiccant to remove water content from the air upstream of the compressor 260. After the air is dried to a desired humidity level and cooled in the conditioner 214, the dehumidified air egresses through an air outlet conduit 224 operably coupled to the dehumidifier 220. The air is then directed to the compressor (airend) 260.

In the exemplary embodiment the compressor 260 is an oil flooded screw compressor wherein oil is injected into the compressor 260 to provide temperature control of the compressor discharge fluid. After compression, the mixture of air and oil is directed to a separator tank 270 whereby air and oil are separated in a manner that is known by those skilled in the art. An air outlet conduit 272 directs the relatively pure air to the aftercooler 274. In some embodiments a water separator 280 operable for removing water particles from the air and a dryer 292 operable for removing water vapor from the air can be positioned downstream of the aftercooler 274. After exiting the dryer 292, the compressed air is delivered to a storage tank (not shown) or an end use machine (also not shown) and the like.

After the oil is separated from the air in the air-oil separator tank 270, the oil is removed through an oil outlet conduit 276 operably connected to the air-oil separator tank 270. The oil is heated from the compression process in the compressor 260 and may be cooled in some instances in an oil cooler 290. The oil flows through the oil circuit 212 from the separator tank to a control system 279. The control system 279 can include one or more control valves 281, one or more sensors 282 and an electronic controller including a microprocessor with a programmable memory. The control valve 281 can be operably connected to the one or more sensors 282 and the electronic controller 284 so as to provide for an active real-time control system. The sensors 282 can include but are not limited to pressure, temperatures, mass flow, speed sensors, hygrometers, and relative humidity (RH) sensors positioned in various locations throughout the compressor system 200 as one skilled in the art would readily understand. In some embodiments separate pumps (not shown) can be positioned in the oil circuit to move the oil from one location to another, however, in other embodiments the pressurized fluid discharged from compressor 260 can cause the oil to flow at a velocity required to provide a desired oil flow rate.

The relatively hot oil can be used to regenerate the dehumidifier in certain embodiments such as those using desiccate-type dehumidifier configuration. The heated oil can help to dry out or regenerate the desiccate that has absorbed water from the air as the air flows through the dehumidifier 220. The oil can be cooled in the oil cooler 290 prior to flowing through the regenerator 218, however, the temperature of the oil is still at an elevated temperature at this point in the flow circuit 212 and therefore capable of regenerating the dehumidifier 220. The regeneration occurs when oil is directed through the regenerator 218 in the oil circuit 212. After exiting from the regenerator 218, the oil is directed back to one or more of the control valves 281 wherein the cooled oil mixes with uncooled oil and is then delivered back to the compressor 260 through an oil inlet at a desired temperature.

In one form an air mover such as a blower or fan 298 can be used to blow (or draw) air from an ambient source represented by arrows 299 through the aftercooler 274, the oil cooler 290 and regenerator 218 to cool the compressed air, the oil and portions of the regenerator 218, respectively. In the illustrated embodiment the air blower 298 delivers cooling air to the aftercooler 298, the oil cooler 290 and the regenerator 218 in series. In other forms the flow 299 to each of the cooled systems may be delivered in parallel and/or additional air movers or blowers may be used. In still other forms the flow 299 may be shut off or diverted from one or more of the aftercooler 298, oil cooler 290 and regenerator 298 in certain embodiments.

In operation the controller 284 along with the one or more control valves 281 and the sensors 282 are operable for controlling the temperature of the oil injected into the compressor 260. In some embodiments it is desirable that the temperature of the discharged compressed fluid is at or above a pressure dew point temperature at a particular compressor operating point so that liquid water is not precipitated out of the working fluid mixture of air and oil. The desired temperature can be the pressure dew point temperature at the particular operating condition plus a temperature margin for a safety factor that may include an increase in the target temperature from 1° F. to as many as 20° F. or higher to insure that the discharge temperature remains above the dew point temperature downstream of the compressor 260.

Figure 3:
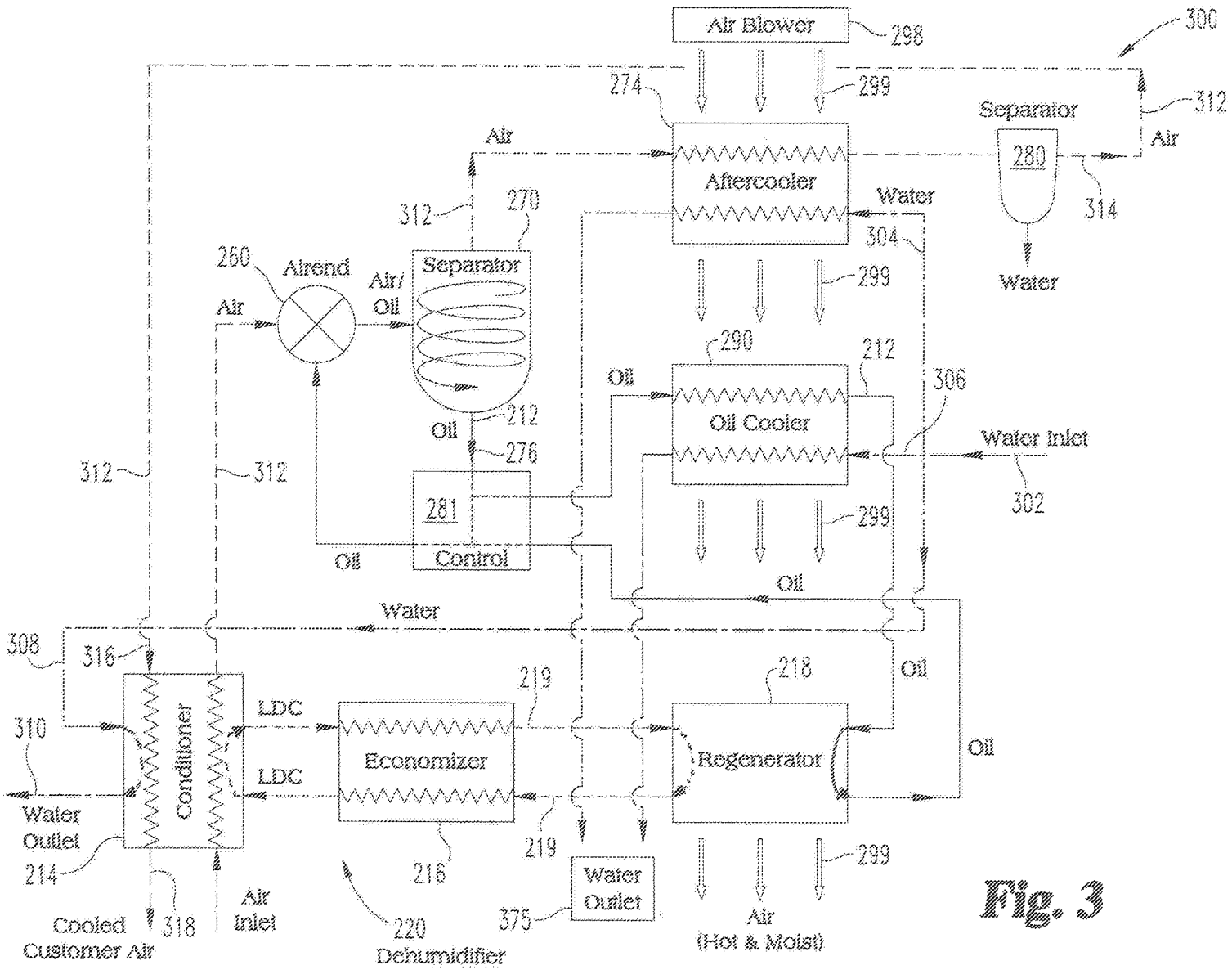
FIG. 3 is a schematic view of a fluid flow diagram according to another embodiment of the present disclosure.

Referring now to FIG. 3, another embodiment of a compressor system 300 is disclosed. The embodiment illustrated in FIG. 3 is similar to the embodiment illustrated in FIG. 2 in certain aspects as illustrated with components having the same callout numbers and will not be described again. In this configuration a main water inlet 302 is in fluid communication with an aftercooler inlet 304, an oil cooler inlet 306 and a conditioner inlet 308. Each of the component water inlets 304, 306, and 308 are fed from the main water inlet 302 in parallel. In some forms, the water exiting the aftercooler 274 and the oil cooler 290 is directed to a water drain 375 and the water exiting the conditioner 214 exits through a water outlet 310. In other forms not shown, the water outlet 310 may be in fluid communication with the water drain 375 such that each of the water passageways converges together at the water drain 375.

In this form, an air circuit 312 follows a similar path to that of FIG. 2. However when the air circuit 312 exits the water separator 280 through a water separator outlet 314, the air circuit 312 passageway loops back through a second air inlet 316 coupled to the conditioner 214. The compressed air is further dried to remove at least a portion of any remaining water vapor entrained with the compressed air stream and to cool the compressed air to a temperature required for customer end use at the outlet 318.

Figure 4:
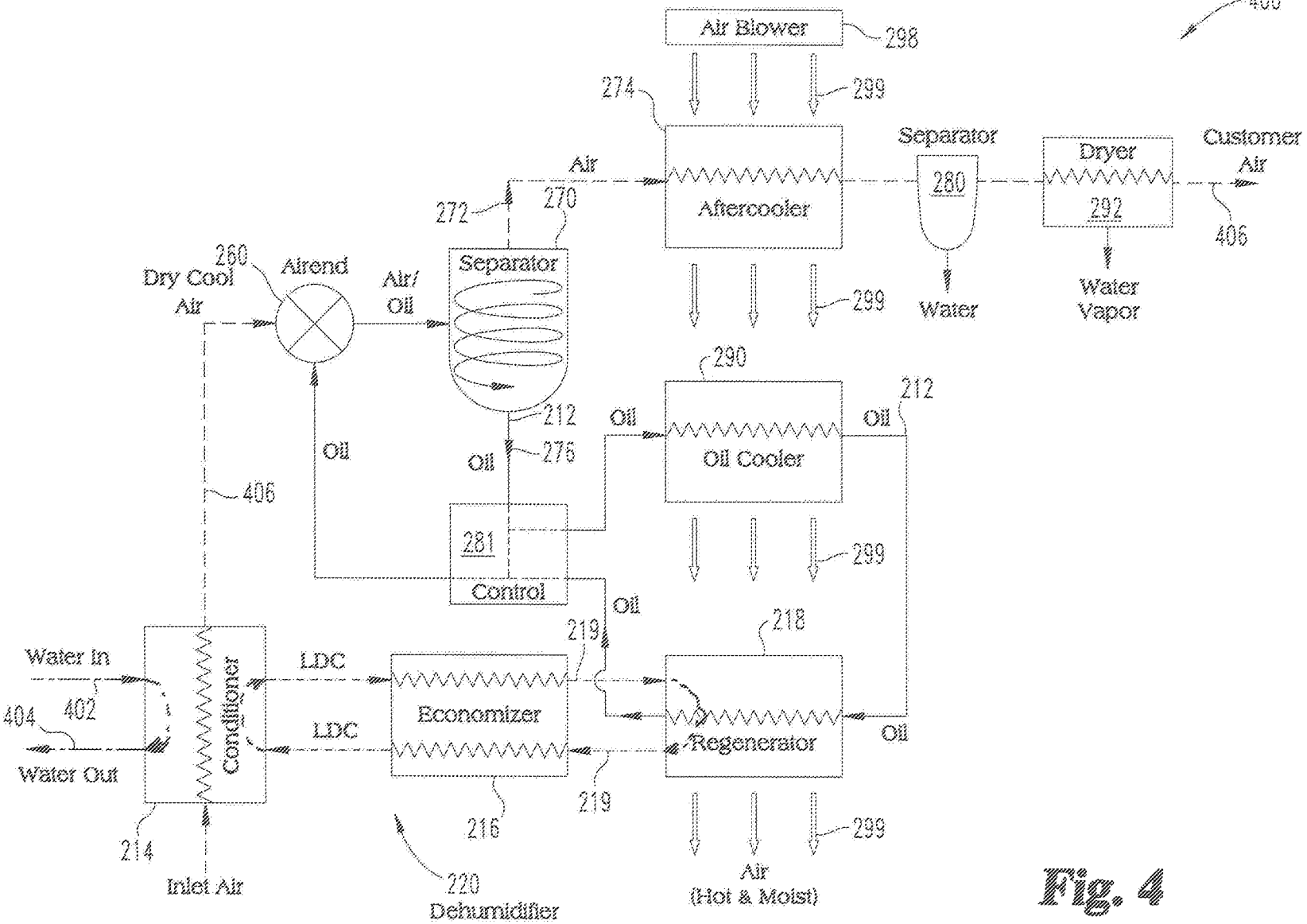
FIG. 4 is a schematic view of a fluid flow diagram according to another embodiment of the present disclosure.

Referring now to FIG. 4, another embodiment of a compressor system 400 is disclosed. The embodiment illustrated in FIG. 4 is similar to the embodiment illustrated in FIG. 2 in certain aspects as defined with those components with the same callout numbers and will not be described again. In this configuration a main water inlet 402 is in fluid communication with the conditioner 214 and the water circuit exits the conditioner 214 through a water outlet 404 and is not directed to another component. While the air circuit 406 depicted herein is similar to the air circuit shown in FIG. 2, it should be understood that the air circuit 406 may loop back through the conditioner downstream of the dryer 292 to further cool and dry the compressed air as illustrated in the embodiment depicted in FIG. 3.

Figure 5:
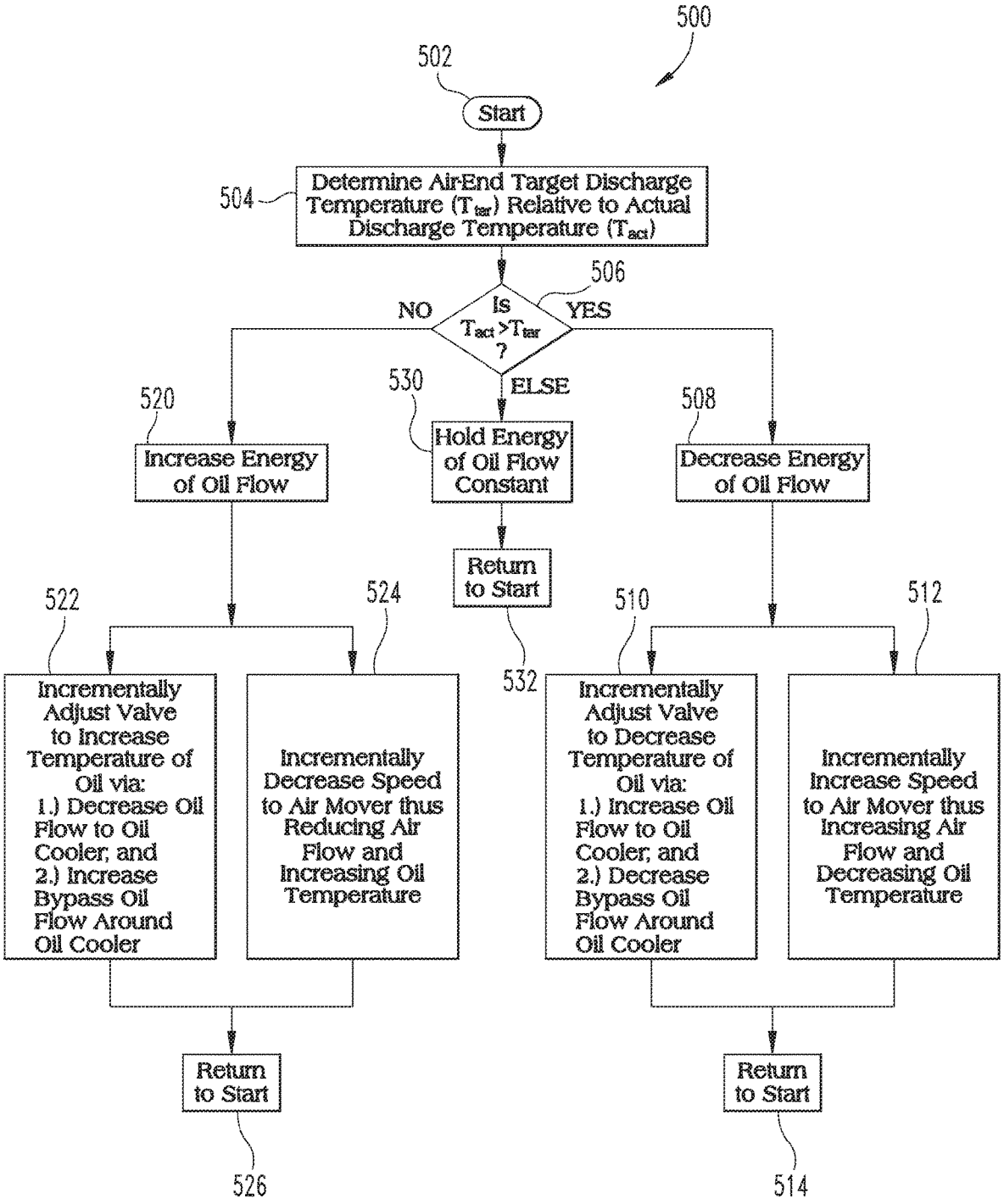
FIG. 5 shows an exemplary flow chart illustrating a control method according to one embodiment of the present disclosure.

Referring now to FIG. 5, an exemplary control method 500 is disclosed. The control method 500 is initiated at step 502 and determines an airend compressor target discharge temperature $T_{tar}$ relative to an actual discharge temperature $T_{act}$ as measured by one or more sensors in the compressor system. In one form $T_{tar}$ can be defined as the temperature required to ensure that the actual temperature of the compressed fluid is at or above a pressure dew point temperature at any location in the system. In other forms $T_{tar}$ can be defined by additional or other control criteria. If $T_{act}$ is greater than $T_{tar}$ at step 506 then the method moves to step 508 otherwise the method moves to step 520 or step 530. If $T_{act}$ is greater than $T_{tar}$ then the control system will decrease the energy of the oil flow. In one aspect as shown in step 510, decreasing the energy of the oil flow can include incrementally adjusting one or more valves to decrease the temperature of the oil via an increase in oil flow to the oil cooler and/or a decrease a bypass oil flow around the oil cooler. In another aspect as shown in step 512, decreasing the energy of the oil flow can include incrementally increasing the speed of one or more air movers to decrease the temperature of the oil. The method returns back to start 502 at step 514.

If $T_{act}$ is less than $T_{tar}$ at step 506 then the control system will increase energy of the oil flow at step 520. In one aspect as shown in step 522, increasing the energy of the oil flow can include incrementally adjusting one or more valves to increase the temperature of the oil via a decrease in oil flow to the oil cooler and/or an increase a bypass oil flow around the oil cooler. In another aspect as shown in step 524, increasing the energy of the oil flow can include incrementally decreasing the speed of one or more air movers to increase the temperature of the oil. The method returns back to start 502 at step 526.

If $T_{act}$ is equal to or within a predetermined acceptable range of $T_{tar}$ at step 506, the method will hold energy of the oil flow constant at step 530. The method then returns to start 502 at step 532.

Figure 6:
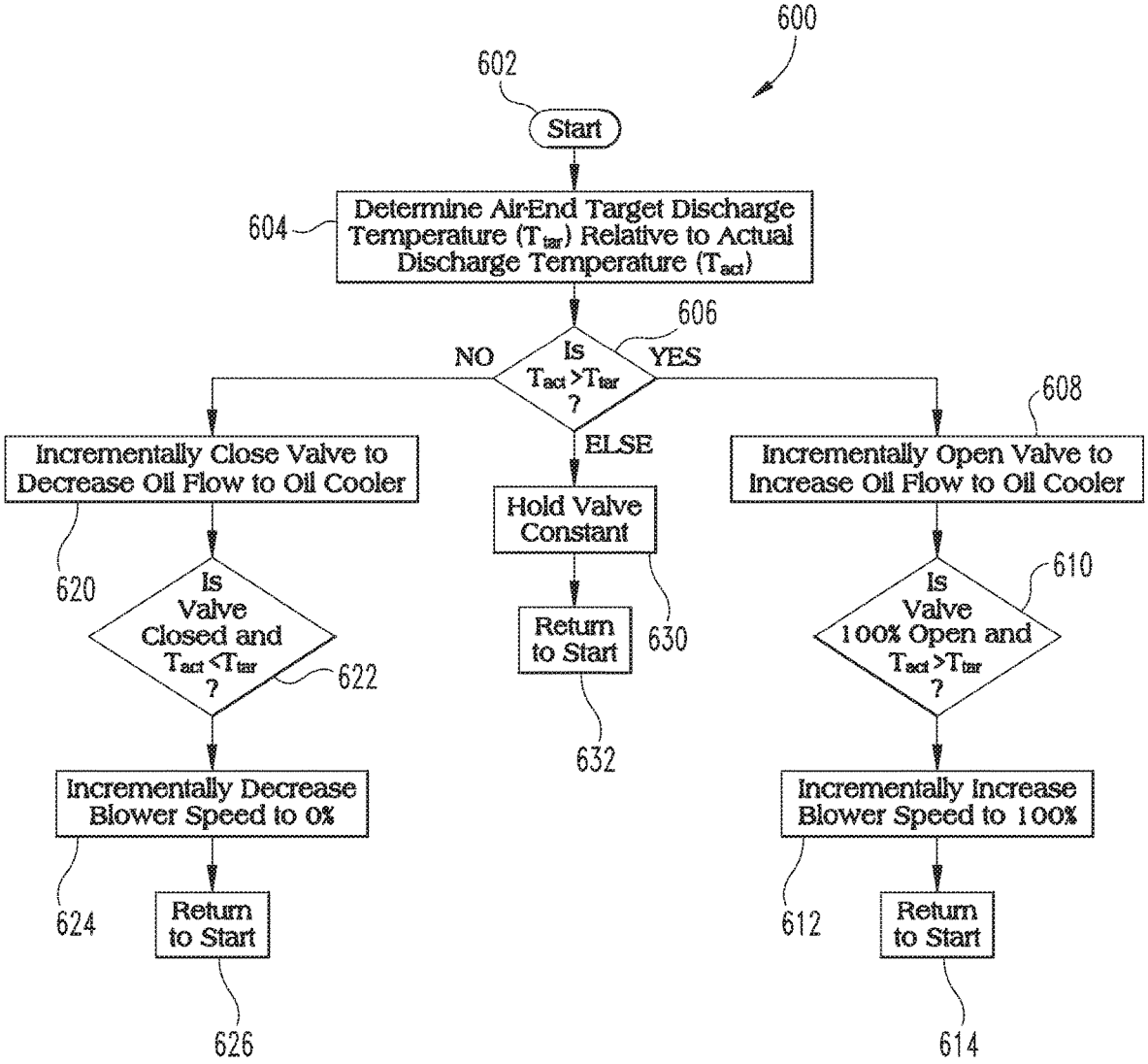
FIG. 6 shows an exemplary flow chart illustrating one exemplary form of the control method illustrated in FIG. 5.

Referring now to FIG. 6, an exemplary control method 600 is disclosed in one form illustrative of the control system of FIG. 5. The control method 600 is initiated at step 602 and determines an airend compressor target discharge temperature $T_{tar}$ relative to an actual discharge temperature $T_{act}$ as measured by one or more sensors in the compressor system. In one form $T_{tar}$ can be defined as the temperature required to ensure that the actual temperature of the compressed fluid is at or above a pressure dew point temperature at any location in the system. In other forms $T_{tar}$ can be defined by additional or other control criteria. If $T_{act}$ is greater than $T_{tar}$ at step 606 then the method moves to step 608 otherwise the method moves to step 620 or step 630. If $T_{act}$ is greater than $T_{tar}$ then the control system will incrementally open the valve in steps to increase the oil flow to the oil cooler. At step 610 the method quarries whether $T_{act}$ is still greater than $T_{tar}$ with the valve open at 100%. If so, the method will incrementally increase an air mover or blower speed up to 100% to provide maximum cooling air to the oil cooler at step 612 and then return back to start 602 at step 614. It should be understood that the incremental increases in valve opening at step 610 and the incremental increases in the air mover or blower speed 612 may not occur in serial fashion in some embodiments (i.e. both steps can occur at the same time in a real time control scheme.)

If $T_{act}$ is less than $T_{tar}$ at step 606 then the control system will incrementally close the valve in steps to decrease the oil flow to the oil cooler at step 620. At step 622 the method quarries whether $T_{act}$ is still less than $T_{tar}$ with the valve in a minimized or closed position. If so, the method will incrementally decrease an air mover or blower speed down to 0% to shut off cooling air to the oil cooler at step 624 and then return back to start 602 at step 626. It should be understood that the incremental decrease in valve position at step 620 and the incremental decrease in an air mover or blower speed a step 624 may not occur in serial fashion in some embodiments (i.e. both steps can occur at the same time in a real time control scheme.)

If $T_{act}$ is equal to or within a predetermined acceptable range of $T_{tar}$ at step 606, the method will hold the valve and air mover or blower constant at step 630. The method then returns to start 602 at step 632.

In one aspect, the present disclosure includes a compressor system comprising: a fluid compressor operable to compress a compressible working fluid; a dehumidifier operable for removing moisture from the compressible working fluid upstream of the fluid compressor, the dehumidifier including a conditioner and a regenerator; an economizer may optionally be associated with the dehumidifier; a lubrication supply system operable for supplying oil to the compressor; an oil cooler configured to cool oil downstream of the fluid compressor; an aftercooler configured to cool compressed air downstream of the fluid compressor; a controller operable for determining a target temperature of a compressed working fluid discharged from the compressor; a control valve operably coupled to the controller and in fluid communication with the oil cooler; and wherein the control valve controls an oil flow rate through the oil cooler such that oil is supplied to the compressor at a predetermined temperature effective to produce compressed working fluid at the target temperature.

In refining aspects, the present disclosure can define the target temperature as the pressure dew point temperature of the working fluid plus a predetermined margin of safety; and includes an electronic controller and a sensor operably coupled to the control valve; a cooling circuit defined within the conditioner; the cooling circuit is further defined within the aftercooler and the oil cooler; wherein the cooling circuit includes water as a cooling fluid; wherein the cooling fluid in the cooling circuit enters the conditioner, the oil cooler and the aftercooler in parallel from a water inlet conduit; one or more air movers in fluid communication with the aftercooler, the oil cooler and the regenerator; a water separator configured to remove water from the compressed air downstream of the compressor; wherein the compressed air is directed through the conditioner after exiting from the water separator and wherein inlet air is directed through the conditioner prior to entering the fluid compressor.

In another aspect the present disclosure includes a system comprising an oil flooded fluid compressor operable for compressing a working fluid having a mixture of oil entrained therein; a dehumidifier operable for removing moisture from a compressible working fluid upstream of the fluid compressor, the dehumidifier including a conditioner and a regenerator; an optional economizer may be associated with the dehumidifier; an air-oil separator in fluid communication with the compressor; an oil cooler configured to cool oil downstream of the air-oil separator; a control valve configured to direct a portion of the oil from the air-oil separator to the oil cooler prior to re-entry into the compressor; one or more sensors operable to transmit signals indicative of a temperature, a pressure, a flow rate and/or a speed; and a controller configured to receive an input signal from the one or more sensors, calculate a target temperature for the compressed working fluid discharged from the compressor and command the control valve to move to a position that results in the compressed working fluid being discharged at the target temperature.

In refining aspects, the present disclosure includes a target temperature that can be defined as a pressure dew point temperature plus a desired temperature margin; an aftercooler positioned downstream of the compressor; one or more air movers or blowers in fluid communication with the aftercooler, the oil cooler and the regenerator; a cooling circuit having a cooling fluid passing through the conditioner; wherein the cooling circuit includes water; a water separator configured to remove water from the compressed air downstream of the compressor; wherein the inlet air is directed through the conditioner upstream of the compressor and the compressed air discharged from the compressor is directed back through the separator prior to customer use.

In another aspect the present disclosure includes a method comprising measuring an actual temperature of a compressed working fluid at a compressor discharge of an oil flooded compressor; conditioning inlet air to a desired temperature and moisture content upstream of the compressor; determining a target compressor discharge temperature for the working fluid; separating oil from the working fluid downstream of the compressor; determining a desired inlet temperature of the oil entering the compressor required to produce the target discharge temperature of the working fluid; and controlling a flow rate of oil through an oil cooler with a control valve to provide the desired oil inlet temperature.

In refining aspects, the present disclosure includes a method for incrementally opening the valve to 100% open when the actual temperature is greater than the target temperature; incrementally increasing a speed of an air mover in fluid communication with the oil cooler until the actual temperature is at or below the target temperature; incrementally closing the valve to 0% open when the actual temperature is below the target temperature; incrementally decreasing a speed of an air mover in fluid communication with the oil cooler until the actual temperature is at or above the target temperature; varying a flow rate of water through a cooling circuit passing through the oil cooler as a function of the desired oil inlet temperature.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a fluid compressor operable to compress a compressible working fluid;

a dehumidifier operable for removing moisture from the compressible working fluid upstream of the fluid compressor, the dehumidifier including a conditioner and a regenerator and a liquid desiccant that circulates between the conditioner and the regenerator, the dehumidifier structured such that the liquid desiccant receives heat in the regenerator and rejects heat in the conditioner;

a lubrication supply system operable for supplying oil to the compressor; an oil cooler configured to cool oil downstream of the fluid compressor;

an aftercooler configured to cool compressed working fluid downstream of the fluid compressor;

a controller operable for determining a target temperature of a compressed working fluid discharged from the compressor;

a control valve operably coupled to the controller and in fluid communication with the oil cooler; and wherein the control valve controls an oil flow rate through the oil cooler such that oil is supplied to the compressor at a predetermined temperature effective to produce compressed working fluid at the target temperature.

2. The compressor system of claim 1, wherein the target temperature is the pressure dew point temperature of the working fluid plus a predetermined margin of safety.

3. The compressor system of claim 1 further comprising an electronic controller and a sensor operably coupled to the control valve.

4. The compressor system of claim 1 further comprising a cooling circuit defined within the conditioner.

5. The compressor system of claim 4, wherein the cooling circuit is further defined within the aftercooler and the oil cooler.

6. The compressor system of claim 5, wherein the cooling circuit includes water as a cooling fluid.

7. The compressor system of claim 5, wherein the cooling fluid in the cooling circuit enters the conditioner, the oil cooler and the aftercooler in parallel from a water inlet conduit.

8. The compressor system of claim 1, further comprising one or more air movers in fluid communication with the aftercooler, the oil cooler and the regenerator.

9. The compressor system of claim 1, further comprising a water separator configured to remove water from the compressed working fluid downstream of the compressor.

10. The compressor system of claim 9, wherein the compressed working fluid is directed through the conditioner after exiting from the water separator.

11. The compressor system of claim 1, wherein inlet air is directed through the conditioner prior to entering the fluid compressor.

12. The compressor system of claim 1, further comprising a water separator configured to remove water from the compressed working fluid downstream of the compressor.

13. The compressor system of claim 12, wherein the inlet working fluid is directed through the conditioner upstream of the compressor and the compressed working fluid discharged from the compressor is directed back through the separator prior to customer use.

14. A system comprising:

an oil flooded fluid compressor operable for compressing a working fluid having a mixture of a compressible gas and oil;

a dehumidifier operable for removing moisture from the compressible gas upstream of the fluid compressor, the dehumidifier including a conditioner in communication with a regenerator such that a liquid desiccant circulates between the conditioner and the regenerator, the regenerator structured to deliver heat to the liquid desiccant and the conditioner structured to extract heat from the liquid desiccant;

a compressible gas-oil separator in fluid communication with the compressor; an oil cooler configured to cool oil downstream of the compressible gas-oil separator;

a control valve configured to direct a portion of the oil from the compressible gas-oil separator to the oil cooler prior to re-entry into the compressor;

one or more sensors operable to transmit signals indicative of a temperature, a pressure, a flow rate and/or a speed; and a controller configured to receive an input signal from the one or more sensors, calculate a target temperature for the compressed working fluid discharged from the compressor and command the control valve to move to a position that results in the compressed working fluid being discharged at the target temperature.

15. The compressor system of claim 14, wherein the target temperature is defined as a pressure dew point temperature plus a desired temperature margin.

16. The compressor system of claim 14 further comprising an aftercooler positioned downstream of the compressor.

17. The compressor system of claim 16 further comprising one or more air movers in fluid communication with the aftercooler, the oil cooler and the regenerator.

18. The compressor system of claim 14 further comprising a cooling circuit having a cooling fluid passing through the conditioner.

19. The compressor system of claim 16, wherein the cooling circuit includes water.

20. A method comprising:

measuring an actual temperature of a compressed working fluid at a compressor discharge of an oil flooded compressor;

conditioning inlet working fluid to a desired moisture content upstream of the compressor, wherein the conditioning includes circulating a liquid desiccant between a conditioner and a regenerator, wherein the conditioning further includes conveying heat to the liquid desiccant in the regenerator and withdrawing heat from the liquid desiccant in the conditioner;

determining a target compressor discharge temperature for the working fluid;

separating oil from the working fluid downstream of the compressor;

determining a desired inlet temperature of the oil entering the compressor required to produce the target discharge temperature of the working fluid; and controlling a flow rate of oil through an oil cooler with a control valve to provide the desired oil inlet temperature.

21. The method of claim 20, further comprising incrementally opening the control valve to 100% open when the actual temperature is greater than the target temperature.

22. The method of claim 21, incrementally increasing a speed of an air mover in fluid communication with the oil cooler until the actual temperature is at or below the target temperature.

23. The method of claim 20, further comprising incrementally closing the control valve to 0% open when the actual temperature is below the target temperature.

24. The method of claim 23, incrementally decreasing a speed of an air mover in fluid communication with the oil cooler until the actual temperature is at or above the target temperature.

25. The method of claim 20, further comprising varying a flow rate of water through a cooling circuit passing through the oil cooler as a function of the desired oil inlet temperature.

* * * * *